US010414563B2

(12) United States Patent
Yang

(10) Patent No.: US 10,414,563 B2
(45) Date of Patent: Sep. 17, 2019

(54) SEALING CAP AND CONTAINER HAVING THE SEALING CAP

(71) Applicant: Fang Lin Yang, Taichung (TW)

(72) Inventor: Fang Lin Yang, Taichung (TW)

( * ) Notice: Subject to any disclaimer, the term of this patent is extended or adjusted under 35 U.S.C. 154(b) by 57 days.

(21) Appl. No.: 15/708,544

(22) Filed: Sep. 19, 2017

(65) Prior Publication Data

US 2019/0084738 A1 Mar. 21, 2019

(51) Int. Cl.

| | |
|---|---|
| ***B65D 51/28*** | (2006.01) |
| ***B65D 85/72*** | (2006.01) |
| ***B65D 41/04*** | (2006.01) |
| ***B05B 11/00*** | (2006.01) |

(52) U.S. Cl.

CPC ..... *B65D 51/2878* (2013.01); *B05B 11/00* (2013.01); *B65D 41/0414* (2013.01); *B65D 41/0428* (2013.01); *B65D 51/2864* (2013.01); *B65D 85/72* (2013.01)

(58) Field of Classification Search

CPC ..... B65D 51/2878; B65D 51/2807; B65D 51/2857; B65D 51/2864; B65D 41/0414; B65D 41/0428

USPC ..... 206/221, 219

See application file for complete search history.

(56) References Cited

U.S. PATENT DOCUMENTS

| | | | | |
|---|---|---|---|---|
| 4,903,828 | A * | 2/1990 | Finke | B65D 23/00 206/221 |
| 7,503,453 | B2 * | 3/2009 | Cronin | B65D 47/243 206/221 |
| 7,909,160 | B2 * | 3/2011 | Patterson | B65D 51/2892 206/221 |
| 2007/0199839 | A1 * | 8/2007 | Sharon | B65D 1/2864 206/219 |
| 2008/0223740 | A1 * | 9/2008 | Ramsey | B65D 51/2864 206/222 |
| 2015/0266634 | A1 * | 9/2015 | Yang | B65D 51/2892 206/221 |

FOREIGN PATENT DOCUMENTS

| | | |
|---|---|---|
| TW | I508899 | 11/2015 |
| TW | I508903 | 11/2015 |

* cited by examiner

*Primary Examiner* — Steven A. Reynolds
(74) *Attorney, Agent, or Firm* — Rosenberg, Klein & Lee

(57) ABSTRACT

The present invention relates to a sealing cap and a container having the sealing cap. Using an opposite screw direction, when a cap body is screwed at a mouth of the container, an inner cover is moved toward a chamber of a container body relative to a lower extension tube of the cap body until an aperture of the lower extension tube is communicated with at least one release hole of the inner cover, such that an additive drops from the release hole to be mixed with the liquid in the container. The operation is simple and clear. When the cap body is rotated to disengage from the mouth, the release hole is closed again to prevent the remaining additive from dripping out of the cap body.

5 Claims, 11 Drawing Sheets

SEALING CAP AND CONTAINER HAVING THE SEALING CAP

FIELD OF THE INVENTION

The present invention relates to a sealing cap and a container having the sealing cap, and more particularly to an apparatus for containing articles.

BACKGROUND OF THE INVENTION

Taiwan Patent Publication No. TWI508903, TWI508899 are previous creations of the applicant. Both the two patents disclose a cap and a container. The cap is composed of a cap body and a retaining member. The retaining member is assembled to the cap body to form a sealing space for filling an additive. By rotating the cap body, the additive can be released from an exposed opening of the retaining member so that the additive can be mixed with the liquid in the container.

The rotation of the cap body is to unscrew the cap body, and then the retaining member is moved upward along with the cap body to expose the opening of the retaining member. After the additive is released from the cap body, the container is shaken to mix the additive with the liquid in the container. For drinking, the cap body is unscrewed to disengage from the cap body. During the process, it is necessary to take many actions for mixing the additive with the liquid of the container. In addition, the additive may drip from the cap body when the cap is removed from the container.

SUMMARY OF THE INVENTION

The primary object of the present invention is to solve the aforesaid problems and to provide a sealing cap and a container having the sealing cap. The screw direction of an inner cover and a cap body is opposite to the screw direction of the cap body and a mouth of the container. When the cap body is screwed at the mouth, the inner cover is moved toward a chamber of the container relative to a lower extension tube until an aperture of the lower extension tube is communicated with at least one release hole of the inner cover, such that an additive drops from the release hole. After that, the container is shaken to mix the additive with the liquid in the container. The action of the cap body is less. When the cap body is detached from the mouth, there is no problem of leakage.

In order to achieve the aforesaid object, a sealing cap and a container having the sealing cap are provided. The container comprises a container body, an inner cover, and a cap body.

The container body has a chamber therein and a mouth. The mouth has an opening communicating with the chamber.

The inner cover has a hollow shape, and has an open end and a closed end at two ends thereof. The inner cover has a resistance portion on an outer wall thereof. The resistance portion enables the inner cover to be temporarily held against an inner wall of the opening of the mouth. The inner cover has at least one release hole between the resistance portion and the closed end. The inner cover has a first inner threaded portion on an inner wall thereof.

The cap body has a second inner threaded portion to mate with a first outer threaded portion of the mouth. The cap body has a lower extension tube to extend into the opening. The lower extension tube has an accommodation room to accommodate an additive therein. The lower extension tube has a hollow distal end with an aperture. An outer wall of the lower extension tube has a second outer threaded portion. The first inner threaded portion is screwed to the second outer threaded portion until the distal end of the lower extension tube leans against the closed end. The aperture and the release hole are temporarily closed and not communicated with each other. A screw direction of the first inner threaded portion of the inner cover and the second outer threaded portion of the lower extension tube is opposite to a screw direction of the second inner threaded portion and the first outer threaded portion.

The inner cover has the resistance portion to be temporarily held against the inner wall of the opening of the mouth. When the cap body is screwed at the mouth, the inner cover is moved toward the chamber of the container body along with rotation of the cap body and is further moved toward the chamber of the container body relative to the lower extension tube in the screw direction of the second inner threaded portion and the first outer threaded portion until the distal end of the lower extension tube is disengaged from the closed end, and the aperture of the lower extension tube is communicated with the at least one release hole so that the additive drops from the at least one release hole.

DETAILED DESCRIPTION OF THE PREFERRED EMBODIMENTS

As shown in FIG. 1 to FIG. 11, embodiments of the present invention will now be described, by way of example only, with reference to the accompanying drawings. The inventive concept may, however, be embodied in many different forms and should not be construed as being limited to the embodiments set forth herein.

The present invention provides a sealing cap and a container having the sealing cap. In a first embodiment, as shown in FIG. 1 to FIG. 2, the sealing cap may be mounted on a container body 1, and includes an inner cover 2 and a cap body 3.

Figure 2:
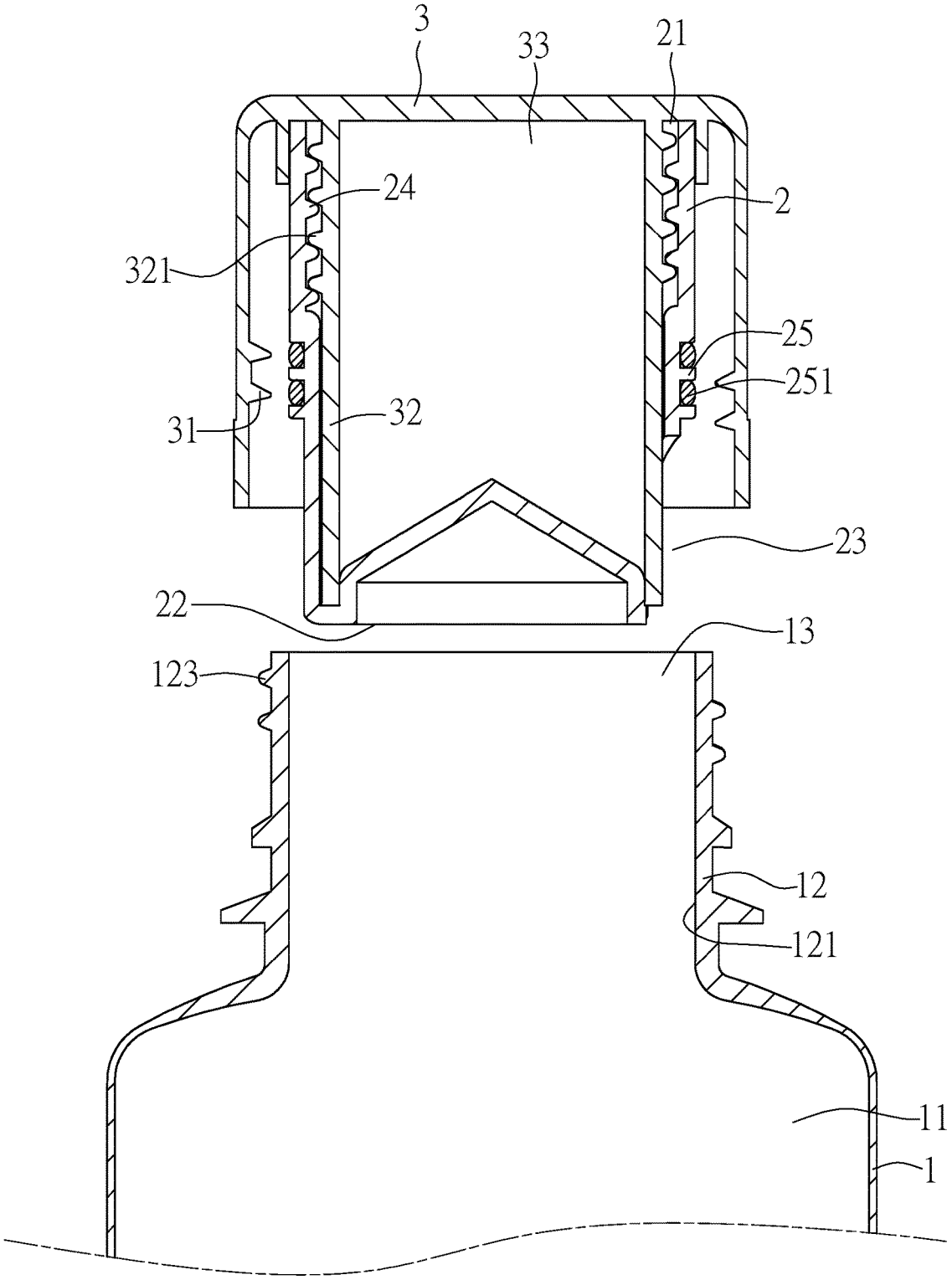
FIG. 2 is a sectional view of the sealing cap disengaged from the container body of FIG. 1.

As shown in FIG. 2, the container body 1 has a chamber 11 therein and a mouth 12. The mouth 12 has an opening 13 communicating with the chamber 11. In this embodiment, the container body 1 is a bottle containing a liquid, such as a beverage. In this embodiment, the container body 1 may be any one of the existing bottles on the market to mate with the sealing cap. For example, a commercially available bottle with the cap removed can be used in conjunction with the sealing cap.

Figure 1:
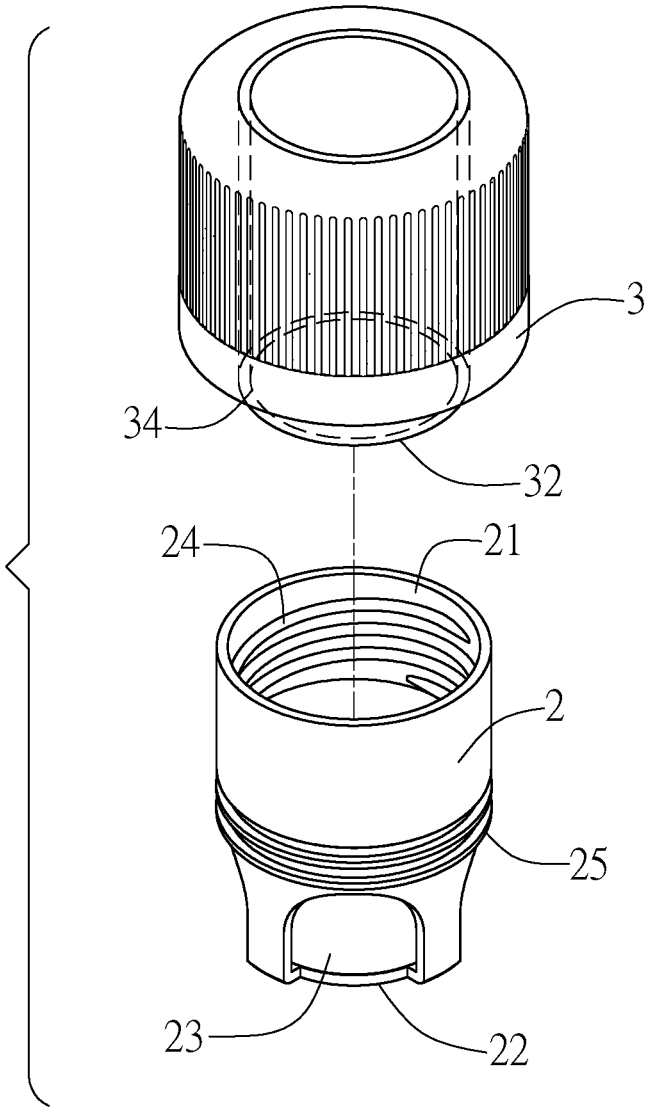
FIG. 1 is an exploded view of the cap body, the inner cover and the container body in accordance with a first embodiment of the present invention.

As shown in FIG. 1 and FIG. 2, the inner cover 2 has a hollow shape, and has an open end 21 and a closed end 22 at two ends thereof. The inner cover 2 has a resistance portion on an outer wall thereof. The resistance portion enables the inner cover 2 to be temporarily held against an inner wall 121 of the opening 13 of the mouth 12. The inner cover 2 has at least one release hole 23 between the resistance portion and the closed end 22. The inner cover 2 has a first inner threaded portion 24 on an inner wall thereof. In this embodiment, the first inner threaded portion 24 is located between the resistance portion and the open end 21.

Figure 3:
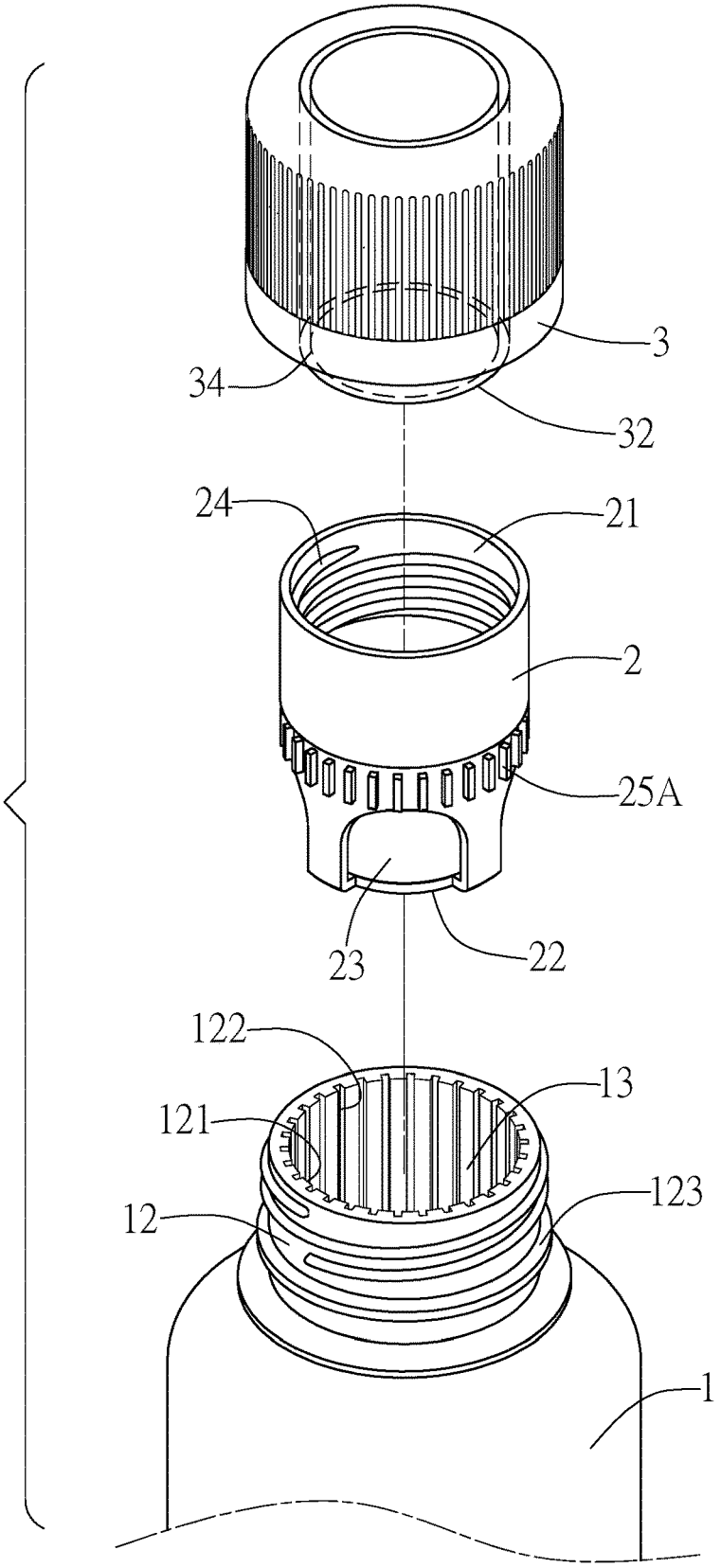
FIG. 3 is an exploded view of the cap body, the inner cover and the container body in accordance with a second embodiment of the present invention.

As shown in FIG. 1 to FIG. 2, in this embodiment, the resistance portion includes a plurality of annular protrusions 25. Each of the annular protrusions 25 protrudes radially from the inner cover 2. An O-shaped ring 251 is provided between the annular protrusions 25. The O-shaped ring 251 provides an anti-leakage effect and facilitates the annular protrusions 25 to be positioned on the inner wall 121. As shown in FIG. 3, in the second embodiment, the resistance portion may include a plurality of protrusions 25A. The protrusions 25A protrude radially from the inner cover 2 and are arranged in a circle. The mouth 12 has a plurality of grooves 122 in the opening 13, so that the plurality of protrusions 25A are engaged in the grooves 122 so as to prevent the plurality of protrusions 25A from rotating in the opening 13 of the inner cover 2 relative to the mouth 12. In the above-described embodiment, the inner cover 2 has a plurality of release holes 23 arranged in a circle. In the present invention, the resistance portion is temporarily held against the inner wall 121 in the opening 13 of the mouth 12, not limiting the resistance portion from being displaced or rotated relative to the inner wall 121. When the inner cover 2 is applied with a force greater than the force of engagement, the inner cover 2 can be displaced or rotated in the opening 13 by overcoming the resistance.

As shown in FIG. 1 to FIG. 3, the cap body 3 may be screwed to or unscrewed from the mouth 12. The cap body 3 has a second inner threaded portion 31, and the mouth 12 has a first outer threaded portion 123 to mate with the second inner threaded portion 31. The cap body 3 has a lower extension tube 32. When the cap body 3 is screwed to the mouth 12, the lower extension tube 32 is inserted into the opening 13. The lower extension tube 32 has an accommodation room 33 to accommodate an additive therein. The lower extension tube 32 has a hollow distal end with an aperture 34. An outer wall of the lower extension tube 32 has a second outer threaded portion 321. The first inner threaded portion 24 is screwed to the second outer threaded portion 321 until the distal end of the lower extension tube 32 leans against the closed end 22. The aperture 34 and the release hole 23 are temporarily closed and not communicated with each other. The additive may be a liquid, such as vinegar, wine and coffee, or may be a powder, such as vitamin powder, green tea powder and enzyme powder, for mixing with the liquid or powder contained in the container body 1. The screw direction of the first inner threaded portion 24 of the inner cover 2 and the second outer threaded portion 321 of the lower extension tube 32 is opposite to the screw direction of the cap body 3 and the mouth 12, that is, opposite to the screw direction of the second inner threaded portion 31 and the first outer threaded portion 123.

Figure 4:
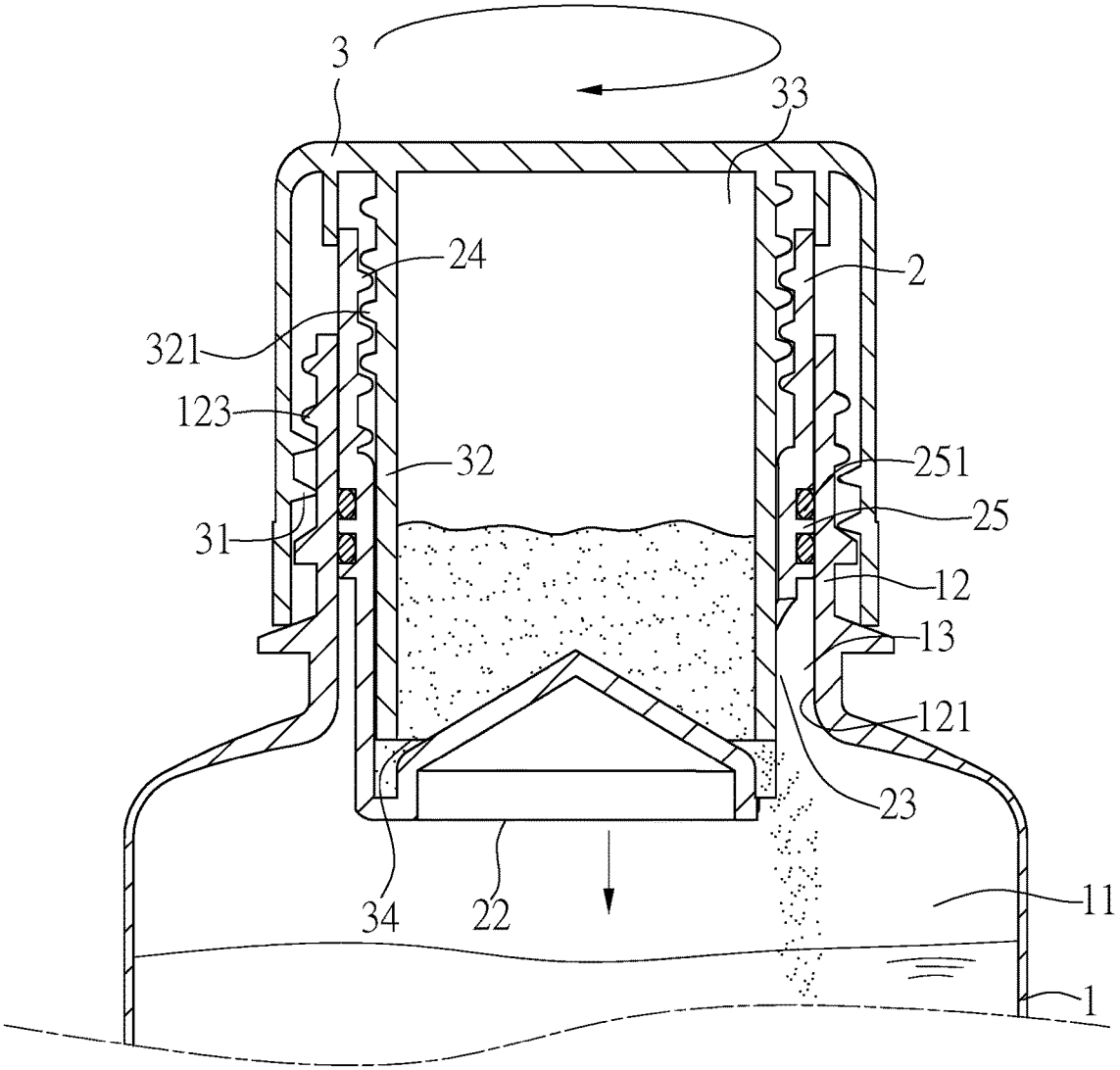
FIG. 4 is a sectional view of FIG. 2, showing that the cap body is screwed downward clockwise and the additive drops from the release hole.
Figure 5:
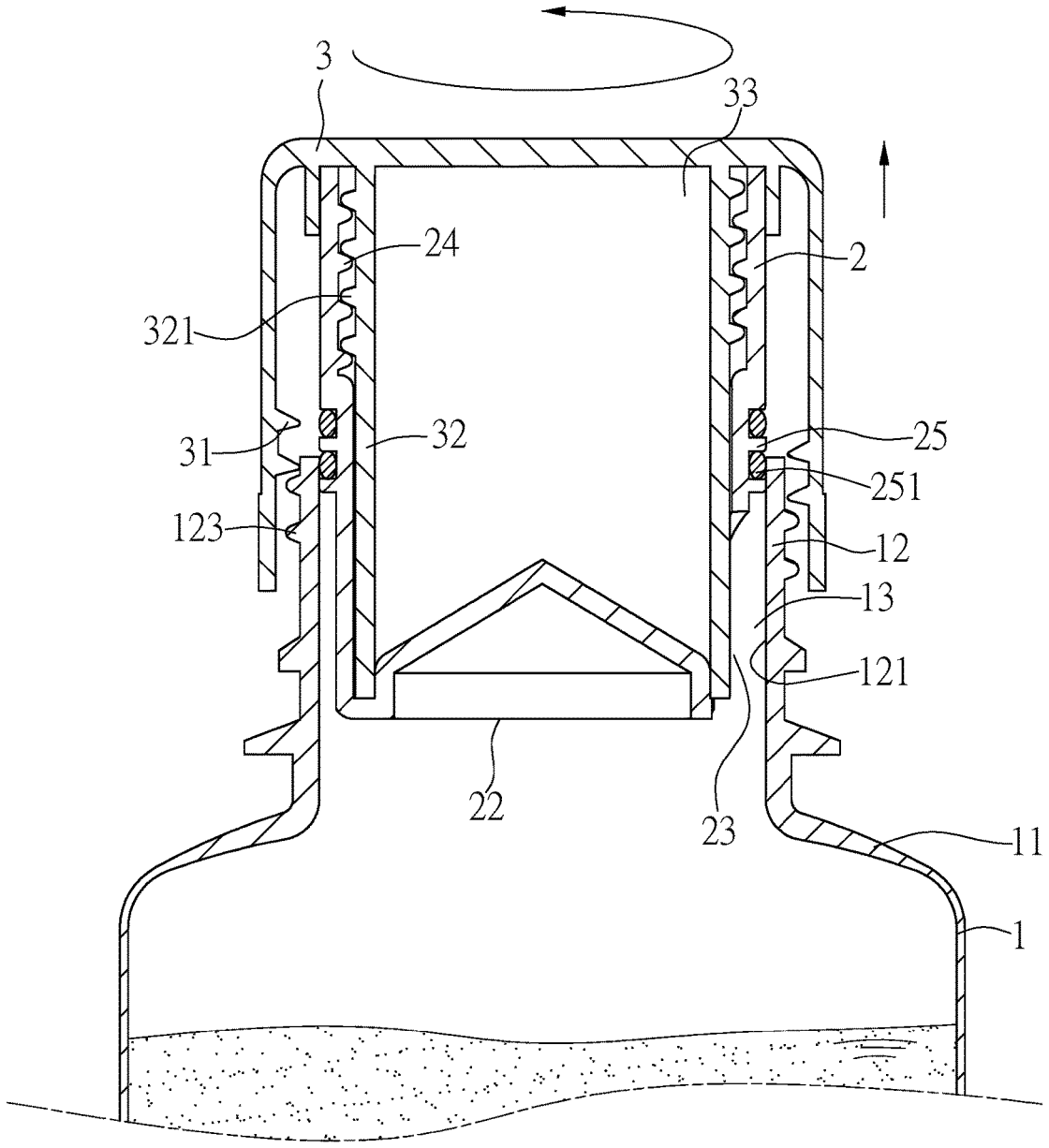
FIG. 5 is a sectional view of FIG. 4, showing that the cap body is unscrewed upward counterclockwise and the inner cover is disengaged from the mouth along with the rotation of the cap body.

As shown in FIG. 4, the sealing cap is screwed to the mouth 12 of the container body 1. If the additive contained in the accommodation room 33 is to be dropped from the release hole 23, the cap body 3 is screwed downward in the clockwise direction relative to the mouth 12. The lower extension tube 32 is rotated in the opening 13 to move toward the chamber 11. The plurality of annular protrusions 25 of the inner cover 2 are temporarily held against the inner wall 121, and won't be rotated with the lower extension tube 32, but are moved along with the lower extension tube 32 toward the chamber 11. The first inner threaded portion 24 of the inner cover 2 are driven by the second outer threaded portion 321 so that the inner cover 2 is moved relative to the lower extension tube 32 toward the chamber 11. Therefore, when the cap body 3 is screwed at the mouth 12, the inner cover 2 is moved in the opening 13 toward the chamber 11 with the rotation of the cap body 3, and is further moved toward the chamber 11 relative to the lower extension tube 32 in the screw direction of the second inner threaded portion 31 and the first outer threaded portion 123 until the aperture 34 and the release hole 23 are opened and communicated with each other to allow the additive to drop from the release hole 23 to mix with the liquid in the chamber 11. The cap body 3 is in a tightened state at the mouth 12, so that the container body 1 can be shaken until the additive and the liquid are mixed to be uniform. As shown in FIG. 5, when the liquid mixed with the additive is to be consumed, the cap body 3 can be unscrewed from the mouth 12 in the counterclockwise direction until the cap body 3 is disengaged from the mouth 12 to expose the opening 13.

Through the above description, it is easy to find an advantage of the present invention in that because the screw direction of the first inner threaded portion 24 of the inner cover 2 and the second outer threaded portion 321 of the lower extension tube 32 is opposite to the screw direction of the cap body 3 and the mouth 12, the cap body 3 is only required to be screwed at the mouth 12, and the inner cover 2 is moved toward the chamber 11 of the container body 1 relative to the lower extension tube 32 to expose the release hole 23 of the inner cover 2, so that the additive drops from the exposed release hole 23, and the container body 1 is shaken to mix the additive with the liquid in the container body 1. The conventional cap is first screwed and then unscrewed to release the additive, after that, the container is shaken and the cap is unscrewed to be opened for drinking the liquid in the container. As to the present invention, it is only necessary to perform the action of screwing and unscrewing once, and the release hole 23 is closed when the cap body 3 is detached from the mouth 12, so that there is no problem of leakage.

Figure 6:
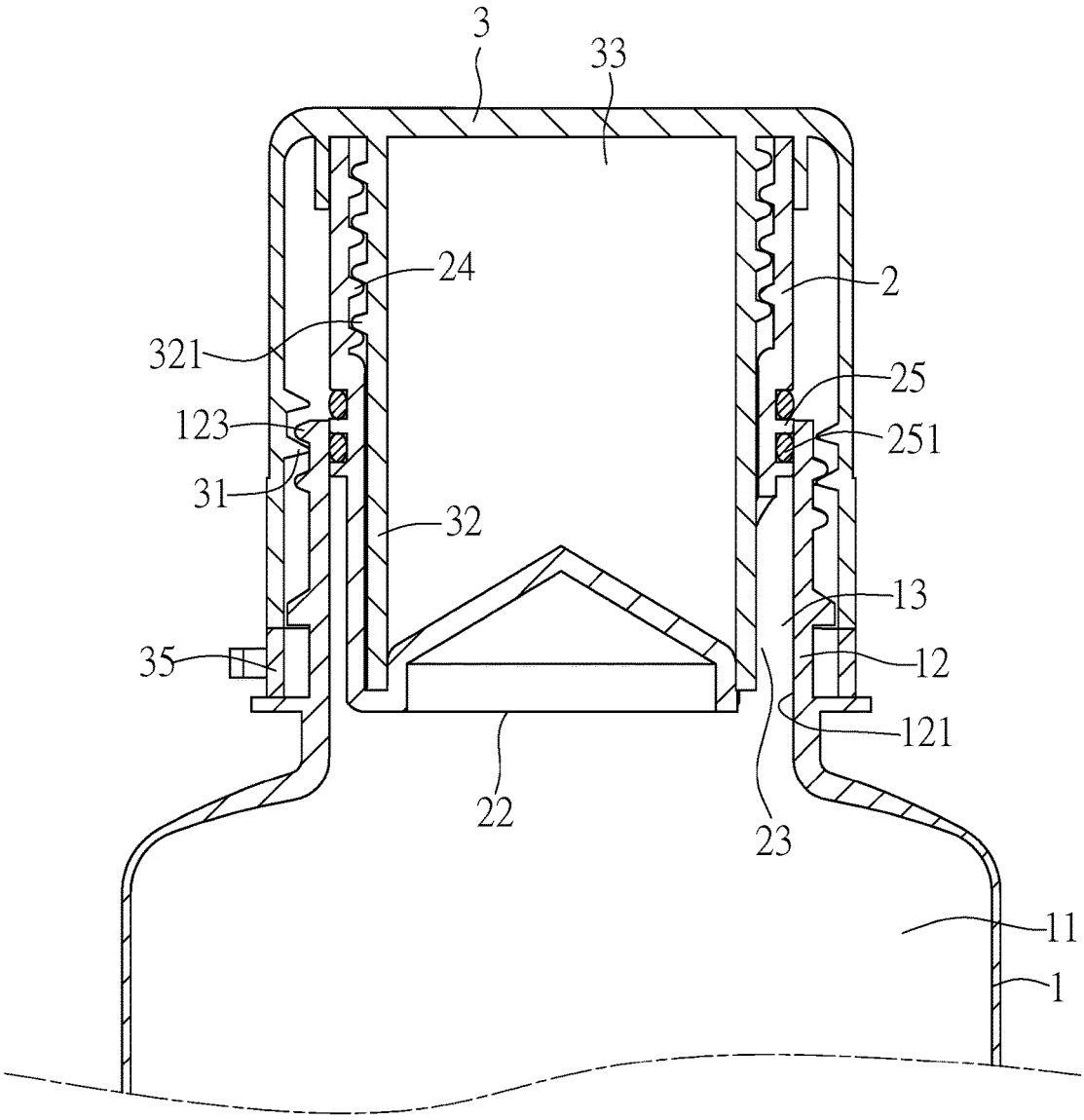
FIG. 6 is a sectional view in accordance with a third embodiment of the present invention provided with the pull ring.

As shown in FIG. 6, in a third embodiment, the container and the sealing cap are a combination of commercialization. For the container, not the aforesaid one, able to mate with the sealing cap, a pull ring 35 is connected to the cap body 3, and the pull ring 35 is rotated into the mouth 12 with the cap body 3. The space in which the cap body 3 can be screwed to the mouth 12 is reserved by the pull ring 35. At this time, if the cap body 3 is screwed, it is blocked by the pull ring 35 to avoid accidentally screwing the cap body 3 and mistakenly releasing the additive from the accommodation room 33. When the additive is to be released, the pull ring 35 is removed from the cap body 3 before the cap body 3 is screwed to the mouth 12, so that the space of the pull ring 35 at the bottom of the cap body 3 is vacated, and the cap body 3 can be screwed again for the additive to be released from the release hole 23 as the aforesaid operation.

Figure 7:
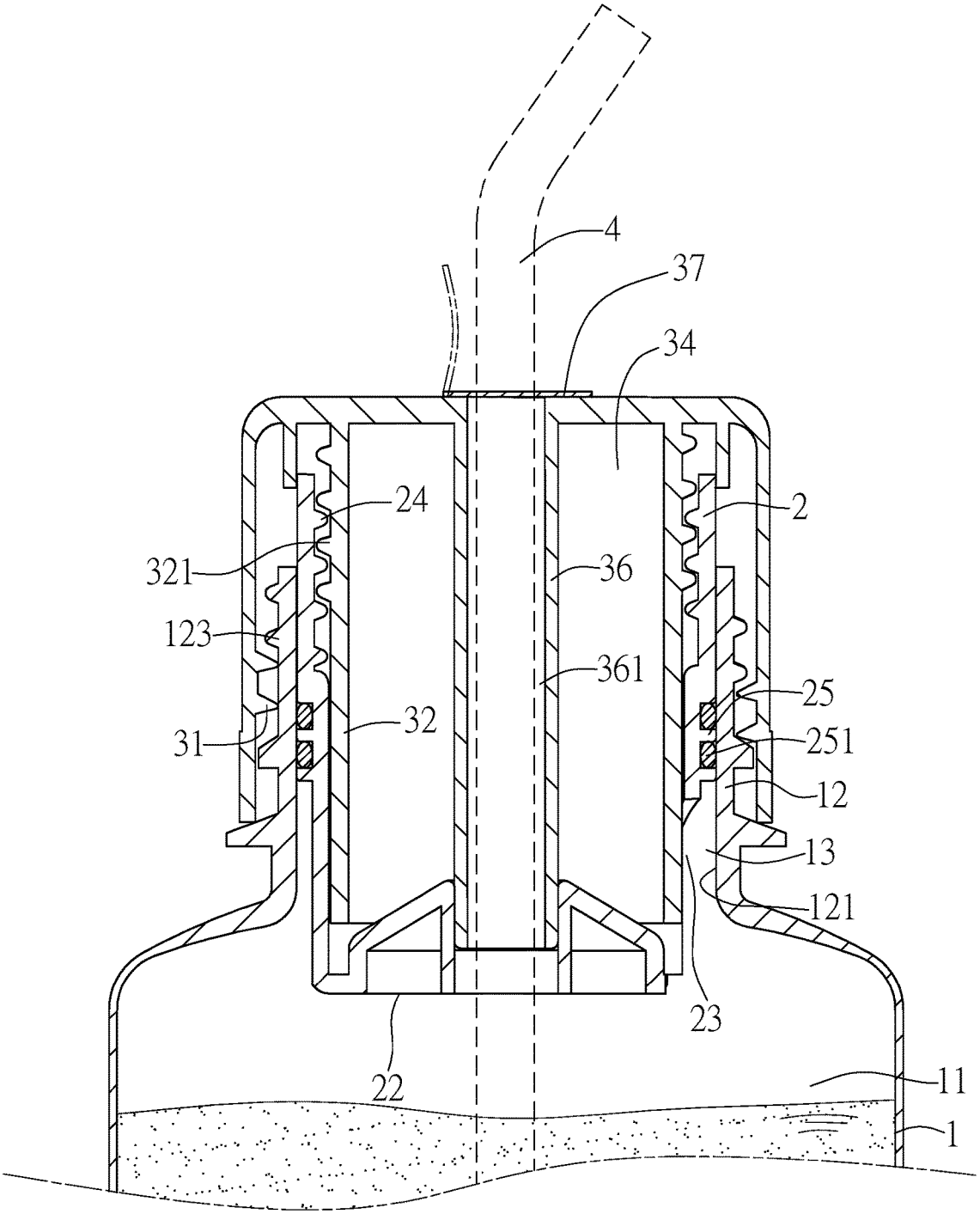
FIG. 7 is a sectional view in accordance with a fourth embodiment of the present invention, showing that the leakproof member of the cap body is removed and the straw is inserted in the chamber of the container body through the through hole of the inner tube.

In the above embodiment, the cap body 3 of the sealing cap is of a non-opening type. In a different embodiment, the cap body 3 may be provided with a perforation, allowing a straw to be inserted into the chamber 11. In addition to the technical effect of the cap body 3 of the foregoing embodiment, the function for insertion of a straw 4 is also provided. As shown in FIG. 7, in a fourth embodiment, when the inner cover 2 and the lower extension tube 32 are screwed, an inner tube 36 is provided in the lower extension tube 32. The inner tube 36 has one end extending from the cap body 3 and another end extending to the closed end 22. The closed end 22 has a hole 221 for the inner tube 36 to pass therethrough. The inner tube 36 has a through hole 361 communicating with the closed end 22 and the cap body 3 at the two ends thereof. A leakproof member 37 able to seal the through hole 361 is provided at one end of the cap body 3. The leakproof member 37 is a film. When the leakproof member 37 is removed from one end of the through hole 361, the straw 4 can be inserted in the container body 1 through the cap body 3 and the closed end 22 via the through hole 361. In a different embodiment, one end of the inner tube 36 may extend from the closed end 22, and the other end may extend to the cap body 3 (not shown). The inner tube 36 may be formed with the through hole 361 for insertion of the straw 4.

Figure 8:
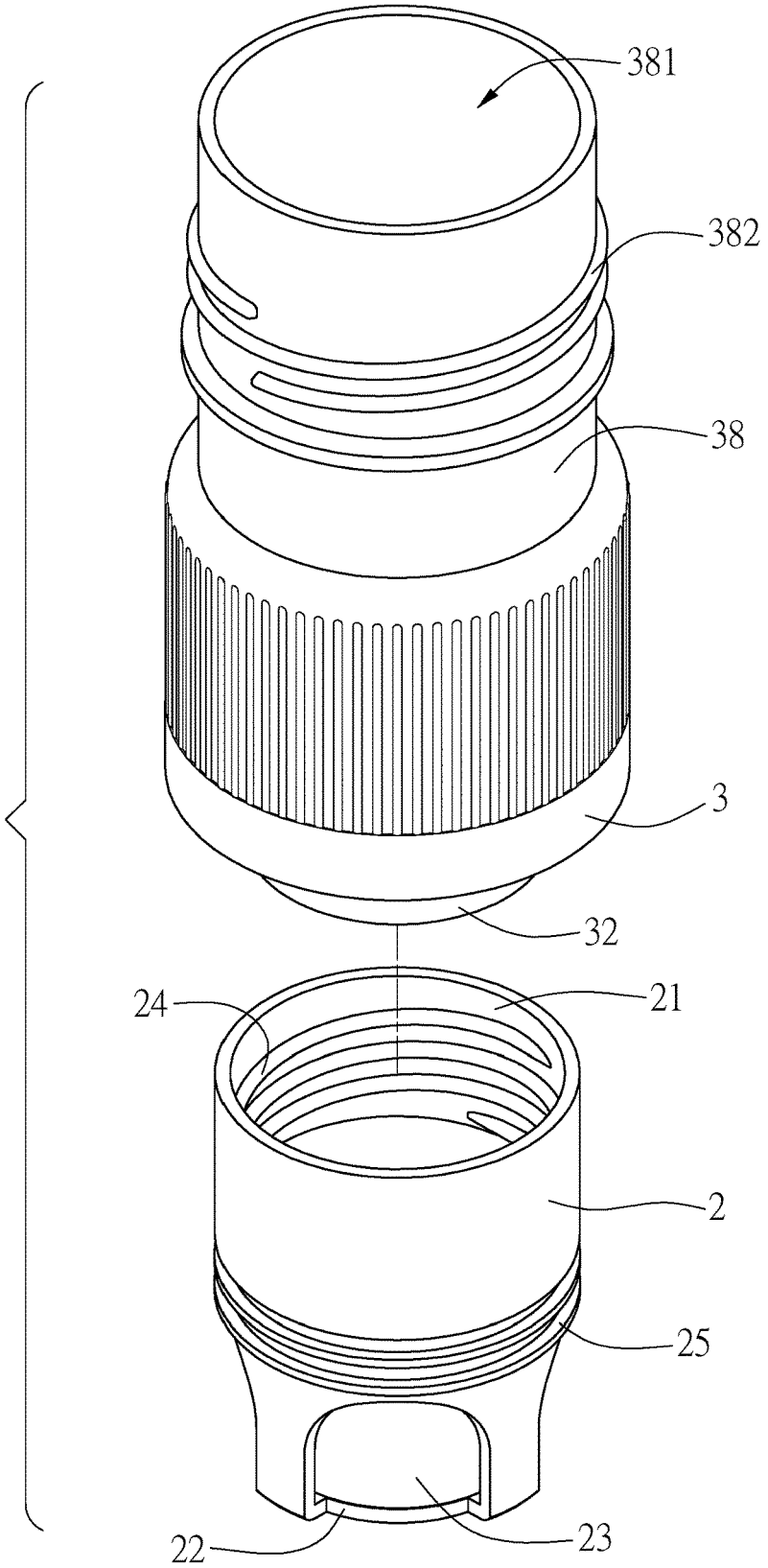
FIG. 8 is an exploded view of the cap body, the inner cover and the container body in accordance with a fifth embodiment of the present invention, showing the upper extension tube provided on the cap body for mounting a nozzle.
Figure 9:
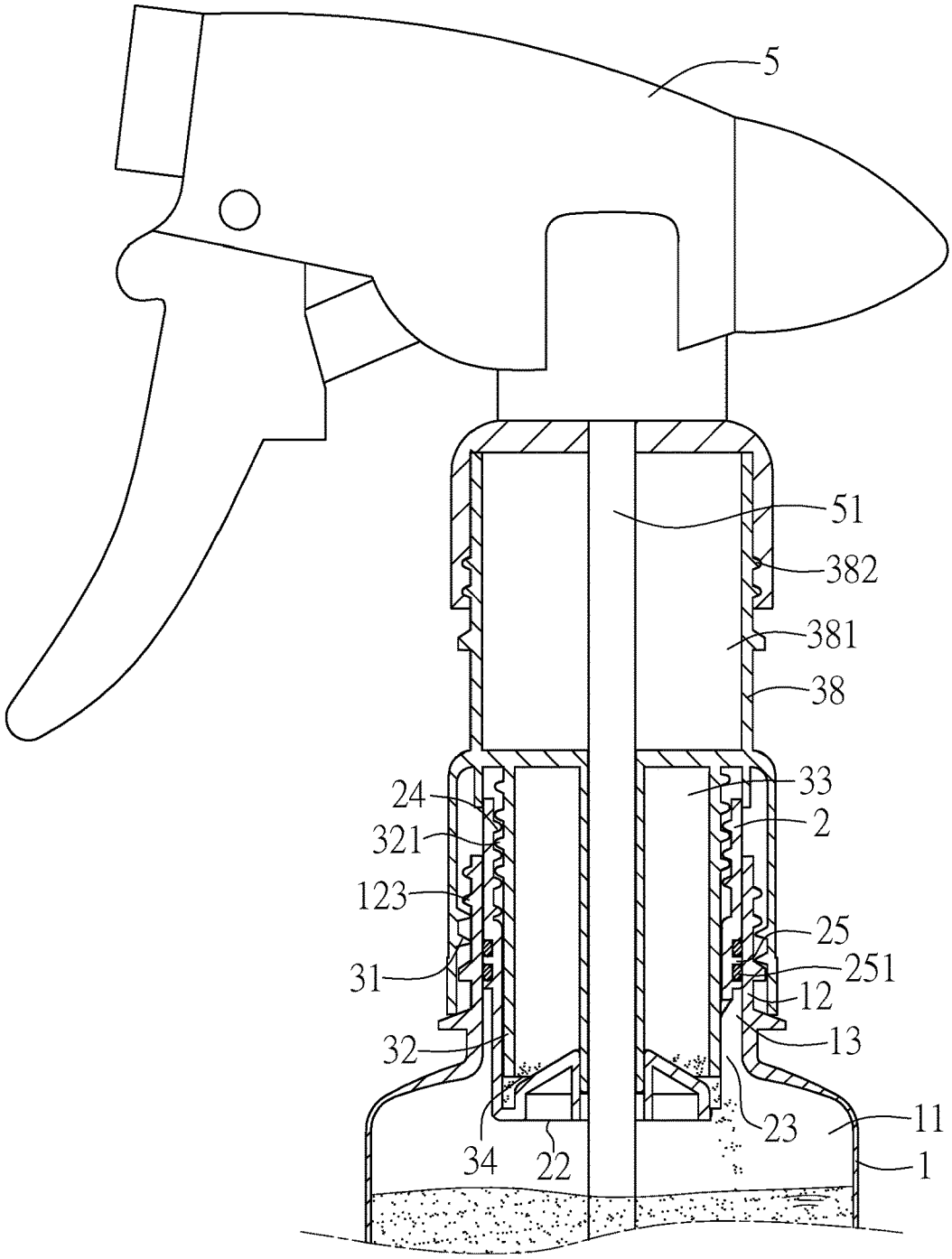
FIG. 9 is a sectional view of the fifth embodiment of the present invention in a use state.

FIG. 8 and FIG. 9 illustrate a fifth embodiment, showing another embodiment of the cap body 3 having the through hole 361. The top of the cap body 3 has an upper extension tube 38. The upper extension tube 38 has a space 381 for the lower extension tube 32 to be completely inserted therein. The upper extension tube 38 has a third outer threaded portion 382. The third outer threaded portion 382 and the second inner threaded portion 31 of the cap body 3 have corresponding threads. One end of the through hole 361, at the cap body 3, is communicated with the upper extension tube 38. The upper extension tube 38 is configured to connect with a suction member 5. The suction member 5 has a suction tube 51 inserted through the inner tube 36 and the through hole 361 to extend into the container body 1. When the suction member 5 is actuated, the suction member 5 is able to suck the solution mixed with the additive in the container body 1. In this embodiment, the suction member 5 is a nozzle as an example. The suction member 5 is locked to the third inner threaded portion 382, so that the liquid contained in the container body 1 can be sucked and atomized. In addition to the above-mentioned nozzle, the suction member 5 may be other objects which can be locked to the upper extension tube 38, such as a rubber nipple, and have a specific function. After the suction member 5 is locked to the upper extension tube 38, it allows the user to suck the liquid in the container body 1.

Figure 10:
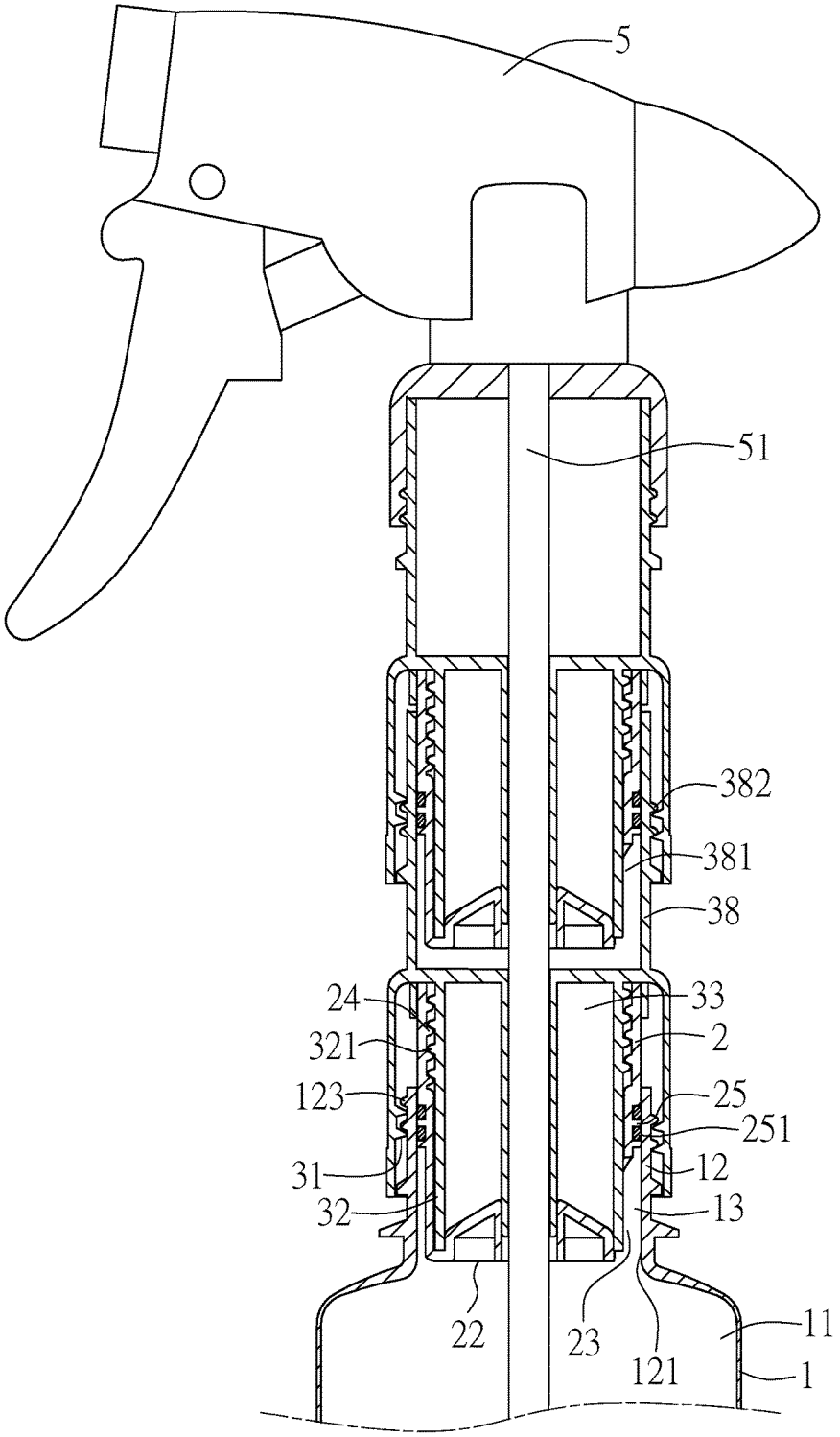
FIG. 10 is a sectional view of the fifth embodiment of the present invention, showing a plurality of sealing cap mounted to the container body.

Accordingly, in addition to the effects of the first embodiment, when there are two or more sealing caps, as shown in FIG. 10, the lower extension tube 32 provided in the inner cover 2 of one sealing cap may be disposed in the upper extension tube 38 of the other sealing cap. The second inner threaded portion 31 of the cap body 3 of one sealing cap is engaged with the third outer threaded portion 382 of the upper extension tube 38 of the other sealing cap, so that the sealing caps are connected in series. When stored, the sealing caps can save the space. In addition, the upper extension tube 38 of the cap body 3 can be directly connected with the suction member 5, so that the suction tube 51 of the suction member 5 is inserted into the container body 1 to suck the solution, facilitating the installation of the suction member 5.

Figure 11:
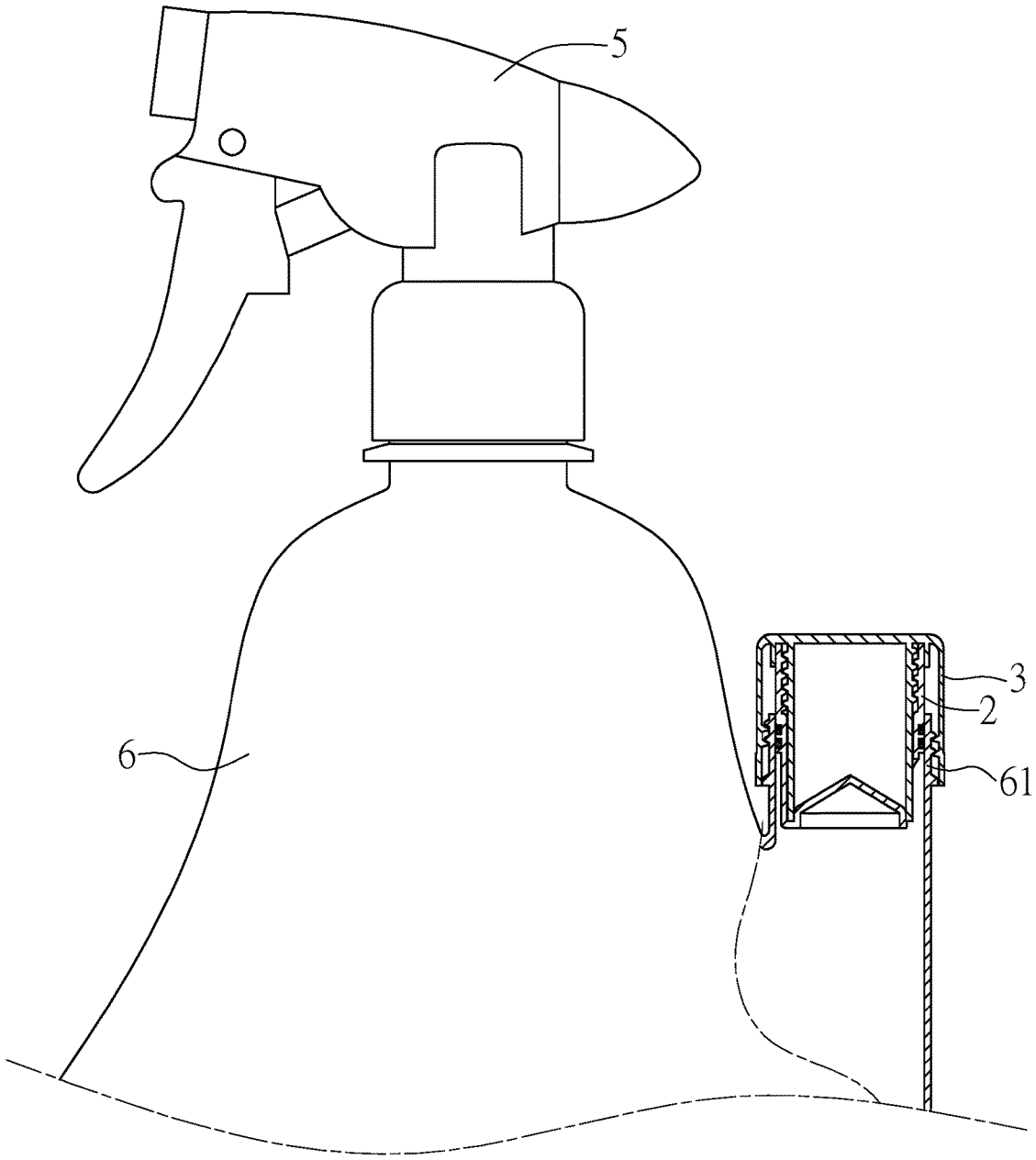
FIG. 11 is a sectional view of the cap body, the inner cover and the container body in accordance with a sixth embodiment of the present invention.

FIG. 11 illustrates a sixth embodiment of the present invention, which is substantially similar to the first embodiment with the exceptions described hereinafter. The sealing cap of this embodiment is applied to a container body 6 which has the same mouth as the first embodiment (not shown) for connecting with the suction member 5 to close the opening 13 of the container body 1. One side of the container body 6 is provided with another mouth 61. The cap body 3 of the sealing cap may be screwed to the mouth 61. In the same use way as the first embodiment, the additive drops into the container body 6 from the mouth 61 to mix with the solution, thereby achieving the same effect as the first embodiment.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A sealing cap, detachably screwed to a mouth having an opening of a container body, comprising:

an inner cover, having a hollow shape and having an open end and a closed end at two ends thereof, the inner cover having a resistance portion on an outer wall thereof, the resistance portion enabling the inner cover to be temporarily held against an inner wall of the opening of the mouth, the inner cover having at least one release hole between the resistance portion and the closed end, the inner cover having a first inner threaded portion on an inner wall thereof;

a cap body, having a second inner threaded portion to mate with a first outer threaded portion of the mouth, the cap body having a lower extension tube to extend into the opening, the lower extension tube having an accommodation room to accommodate an additive therein, the lower extension tube having a hollow distal end with an aperture, an outer wall of the lower extension tube having a second outer threaded portion, the first inner threaded portion being screwed to the second outer threaded portion until the distal end of the lower extension tube engages the closed end, the aperture and the release hole being temporarily closed and not communicated with each other, a screw direction of the first inner threaded portion of the inner cover and the second outer threaded portion of the lower extension tube being opposite to a screw direction of the second inner threaded portion and the first outer threaded portion;

wherein the inner cover is temporarily engaged by the resistance portion against the inner wall of the opening of the mouth, wherein, when the cap body is screwed at the mouth, the inner cover is moved toward a chamber of the container body by rotation of the cap body and is further moved toward the chamber of the container body relative to the lower extension tube in the screw direction of the second inner threaded portion and the first outer threaded portion until the distal end of the lower extension tube is disengaged from the closed end and the aperture of the lower extension tube is communicated with the at least one release hole so that the additive can drop from the at least one release hole, and wherein the release hole is closed by the lower extension tube when the cap body is detached from the mouth.

2. The sealing cap as claimed in claim 1, wherein the resistance portion includes a plurality of annular protrusions protruding radially from the inner cover, or a plurality of protrusions protruding radially from the inner cover and arranged in a circle.

3. The sealing cap as claimed in claim 1, wherein the first inner threaded portion of the inner cover is located between the resistance portion and the open end.

4. The sealing cap as claimed in claim 1, wherein when the inner cover and the lower extension tube are screwedly connected with each other, an inner tube is provided in the lower extension tube, the inner tube has one end extending from one of the closed end and the cap body and another end extending to one of the closed end and the cap body, the inner tube has a through hole communicating with the closed end and the cap body at the two ends thereof, a leakproof member able to seal the through hole is provided at one end of the cap body, when the leakproof member is removed from one end of the through hole, a straw is inserted in the container body through the cap body and the closed end via the through hole.

5. The sealing cap as claimed in claim 4, wherein a top of the cap body has an upper extension tube, the upper extension tube has a space for the lower extension tube to be completely inserted therein, the upper extension tube has a third outer threaded portion, the third outer threaded portion and the second inner threaded portion of the cap body have corresponding threads, one end of the through hole, at the cap body, is communicated with the upper extension tube, the upper extension tube is configured to connect with a suction member, the suction member has a suction tube inserted through the inner tube and the through hole to extend into the container body, when the suction member is actuated, the suction member is able to suck a solution mixed with the additive in the container body.

* * * * *